United States Patent [19]

Betlejewski et al.

[11] 4,157,763

[45] Jun. 12, 1979

[54] ROTATABLE CARRYING HANDLE ARRANGEMENT

[75] Inventors: Frank W. Betlejewski, Elgin; Robert A. Klein, Mount Prospect, both of Ill.

[73] Assignee: Bell & Howell Company, Chicago, Ill.

[21] Appl. No.: 856,711

[22] Filed: Dec. 2, 1977

[51] Int. Cl.[2] ..... B65D 25/28

[52] U.S. Cl. ..... 220/94 R; 220/318; 16/126; 190/58 R; 224/45 P; 312/20; 312/244

[58] Field of Search ..... 16/125–127; 190/57, 58 R, 58 A, 58 B; 220/94 R, 318; 312/244, 20; 224/45 P, 5 V; 352/242

[56] References Cited

U.S. PATENT DOCUMENTS

| | | | |
|---|---|---|---|
| 630,886 | 8/1899 | Held | 16/126 |
| 1,267,948 | 5/1918 | Wiley | 16/126 |
| 2,515,338 | 7/1950 | Colegrove | 312/244 X |
| 3,185,338 | 5/1965 | Henning | 190/58 R |
| 3,339,781 | 9/1967 | Schurman et al. | 190/58 R |
| 3,451,590 | 6/1969 | Johnson et al. | 220/94 R |
| 3,559,779 | 2/1971 | Lautin | 16/126 X |
| 3,562,849 | 2/1971 | Brayshaw | 16/126 |
| 3,707,016 | 12/1972 | Smoot | 16/125 |

*Primary Examiner*—James Kee Chi

*Attorney, Agent, or Firm*—Aaron Passman; James V. Lapacek

[57] ABSTRACT

A carrying handle arrangement for a projector housing or the like is provided wherein the handle frictionally fits with and is retained between first and second housing portions. The carrying handle is rotatable between a first upright carrying position and a second storage position wherein the handle fits within a recess defined within one of the housing portions to form a flat surface with the housing portion. The carrying handle is retained by the frictional fitting of integral bearing pins with respective bearing receivers defined in one of the housing portions.

The handle and bearing receiver structures include a resilient retention arrangement defined by the frictional fit of the bearing receivers and bearing pins. The resilient retention arrangement provides a frictional fit relationship between the handle and the housing. Thus, the handle remains fixed in position for easy grasping in the upright carrying position while restricting movement and preventing rattling of the handle in the recessed storage position.

The resilient retention arrangement can be achieved by fabricating the handle bearing pins with a diameter of a predetermined larger dimension than the dimensions of the bearing receivers. The bearing receivers in one arrangement each include a narrow, elongated slot communicating with the portion of the bearing receiver frictionally fitting the bearing pin. In another arrangement, a diametric slot is defined along a substantial axial length of the bearing pins.

12 Claims, 6 Drawing Figures

ROTATABLE CARRYING HANDLE ARRANGEMENT

CROSS REFERENCE TO RELATED APPLICATIONS

The present application is directed to an improved carrying handle arrangement for a projector housing of the type described in co-pending application Ser. No. 770,254 filed on Feb. 18, 1977, by R. W. H. Kim et al to which reference may be made for a more detailed description of the projector housing and which is hereby incorporated by reference for all purposes.

BACKGROUND AND SUMMARY OF THE INVENTION

The present invention relates generally to carrying handle arrangements for projector housings and the like and more particularly to a carrying handle fitting with and retained by two molded housing portions in a frictional fit relationship provided by a resilient mounting arrangement.

Motion picture projectors and devices including similar housings normally include a carrying handle which is attached to the housing and is rotatable to various positions.

A carrying handle of this general type is shown and described in the aforementioned co-pending application Ser. No. 770,254 filed on Feb. 18, 1977, by R. W. H. Kim et al. In that co-pending application the rotatable carrying handle is retained by the fitting of pins projecting from the handle within respective sockets formed in the housing. The carrying handle is rotatable between an upright carrying position and a flat recessed storage position in a handle receiver recess defined within one of the housing portions.

While carrying handle arrangements of various types and the rotatable carrying handle described in the aforementioned co-pending application are generally suitable for their intended use, the carrying handle is normally loosely retained in the receiver portions of the housing and is rotatable under the weight of the handle or by the application of little or no force making it difficult to retain the handle in the upright position to facilitate grasping. Further, when the handle is in the flat recess storage position, the handle is subject to vibration and rattling during film transport operation through transmitted vibrations in the housing caused by the intermittent motion of the mechanism.

In accordance with the present invention, it is a principal object to provide an improved carrying handle arrangement for a projector housing or the like fitting with and retained by two housing portions in a frictional fit relationship.

It is another object of the present invention to provide a carrying handle arrangement for a motion picture projector or the like wherein the carrying handle is resiliently retained in one housing portion of the projector to provide a frictional fit and is further retained in the first housing portion by the retention structure arrangements of the second interfitting housing portion.

It is a further object of the present invention to provide a carrying handle arrangement for the projector wherein the carrying handle exhibits a predetermined restraining force to movement when in the upright carrying position and prevents rattling or vibration of the handle in a flat storage position during film transport operations.

These and other objects of the present invention are efficiently achieved by providing a carrying handle arrangement for a projector housing or the like wherein the handle fits with and is retained between first and second mating housing portions in a frictional fit relationship. The carrying handle is rotatable between a first upright carrying position and a second storage position wherein the handle fits within a recess defined within one of the housing portions to form a flat surface with the housing portion. The carrying handle is retained by the frictional fit of integral bearing pins with respective bearing receivers defined in one of the housing portions.

The handle and bearing receiver structures include a resilient retention arrangement defined by the fitting bearing receivers and bearing pins. The resilient retention arrangement provides a frictional fit relationship between the handle and the housing. Thus, the handle remains fixed in position for easy grasping in the upright carrying position while restricting movement and preventing rattling of the handle in the recessed storage position.

The resilient retention arrangement can be achieved by fabricating the handle bearing pins with a diameter of a predetermined larger dimension than the dimensions of the bearing receivers. The bearing receivers in a one arrangement include a narrow, elongated slot communicating with the portion of the bearing receiver for the bearing pin. In another arrangement, a diametric slot is defined along a substantial axial length of the bearing pins.

BRIEF DESCRIPTION OF THE DRAWINGS

The invention both as to its organization and method of operation together with further objects and advantages thereof will best be understood by reference to the following detailed description taken in conjunction with the accompanying drawings, wherein.

DESCRIPTION OF THE PREFERRED EMBODIMENT

Figure 1:
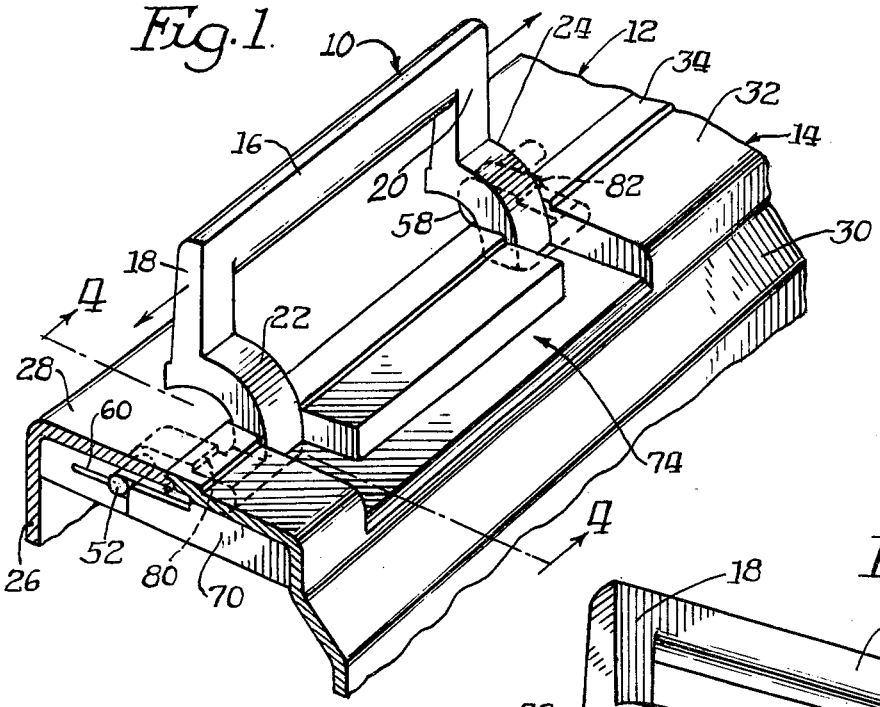
FIG. 1 is a perspective view of a carrying handle arrangement in an assembled position in a motion picture projector housing constructed in accordance with the principles of the present invention.
Figure 2:
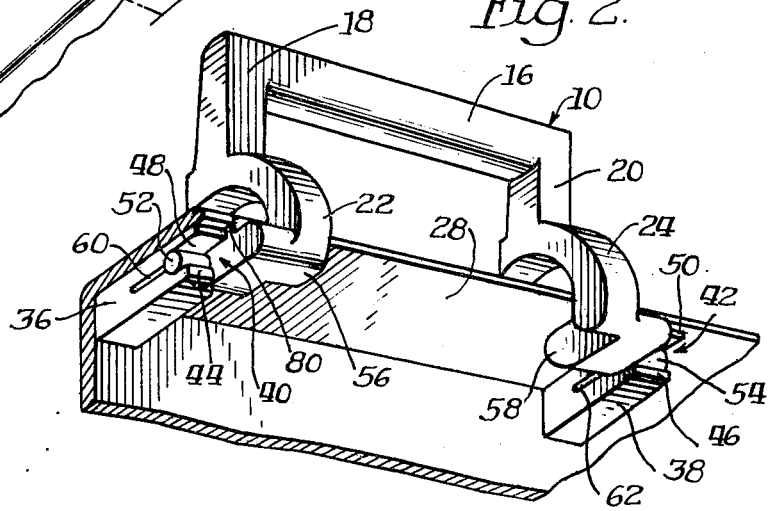
FIG. 2 is a perspective view of the carrying handle and one housing portion of the arrangement of FIG. 1.
Figure 3:
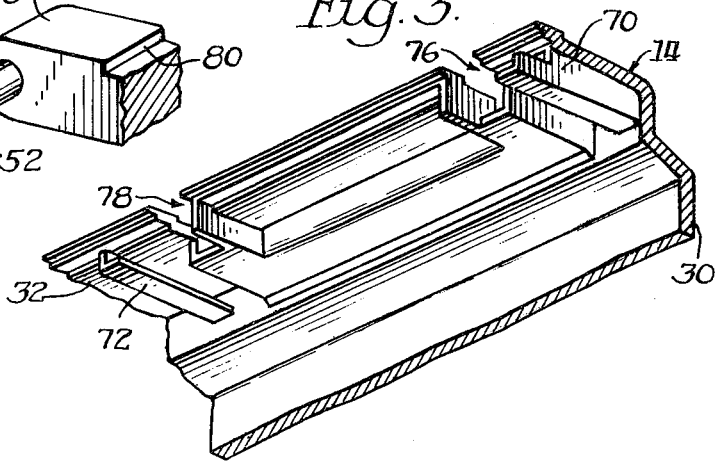
FIG. 3 is a rear perspective view of a second housing portion of the projector of the arrangement of FIG. 1 that mates with the housing portion and carrying handle of FIG. 2.

Referring now to the drawings and particularly to FIGS. 1 through 3, a carrying handle 10 is illustrated in conjunction with first and second housing portions referred to generally at 12 and 14. The carrying handle 10 includes an elongated base portion 16 by which the handle 10 is grasped and two extending legs 18, 20 extending at right angles to the base portion 16 and forming a general overall U-shape with the base 16.

Figure 4:
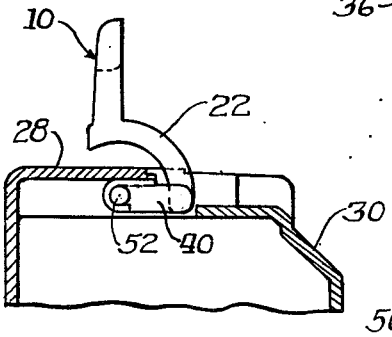
FIG. 4 is a side elevational view partly in section and taken along the line 4—4 of FIG. 1 illustrating the carrying handle in the upright carrying position.
Figure 5:
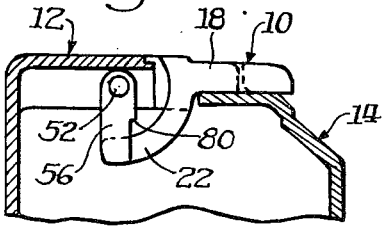
FIG. 5 is a side elevational view partly in section and similar to FIG. 4 but with the carrying handle rotated downward to the flat or recessed storage position.

Each of the extending leg portions 18 and 20 also includes an arcuate depending portion 22, 24 respectively. The arcuate sections 22, 24 extend into cooperating openings between the housing portions 12 and 14. Referring now to FIGS. 4 and 5 the carrying handle 10 is rotatable between an upward carrying or grasping position (FIG. 4) and a flat storage position when rotated downward with the arcuate leg portions 22, 24 extending into the space between the housing portions 12 and 14 (FIG. 5).

The first housing portion 12 includes an upstanding edgewall 26 and a strengthening flange 28, both integrally molded with the housing 12. Similarly, the housing portion 14 includes an edgewall portion 30 and a strengthening flange 32. A raised lip portion 34 is molded along the edge of the strengthening flange 32 and mates with the strengthening flange 28 of the housing portion 12. In one arrangement, the projector housing portion 14 comprises a molded rear cover and the housing portion 12 comprises a molded chassis on which a substantial portion of the operative components of the projector are mounted.

The first housing portion 12 includes two spaced bearing receivers 36, 38 which are best seen in FIG. 2. The bearing receivers 36, 38 also function as housing strengtheners and are integrally molded with the housing 12 to each define a post structure extending generally from the edgewall 26 and across the strengthening flange 28. Each of the bearing receivers 36 and 38 is provided with an open receiver socket 40, 42 respectively. Each of the receiver sockets 40, 42 forms an open slot defining a lower extending bifurcated branch 44, 46 respectively and an upper overhanging branch 48, 50 respectively. The bearing receiver sockets 40, 42 are arranged to accept a respective bearing pin 52, 54 extending from the base of each of the arcuate leg portions 22, 24 respectively.

The legs 18 and 20 of the handle 10 below the arcuate portions 22 and 24 each include a respective widened spacer and strengthening foot 56, 58 extending generally outwardly and perpendicular to the plane of the legs 18 and 20. The bearing pins 52 and 54 extend outwardly and perpendicularly from the feet 56 and 58 respectively and are also perpendicular to the plane of the legs 18 and 20. The faces of feet 56 and 58 to which the base of pins 52 and 54 attach may be spaced apart a predetermined amount such as an interference frictional fit is caused between the faces and the inside walls of receivers 36 and 38. That is to say that the natural resilience of handle 10 may be applied by dimensioning the distance of the faces such that frictional fit is caused when the handle is squeezed and inserted into receiver sockets 40 and 42.

In accordance with an important aspect of the present invention, the bearing pins 52 and 54 are fabricated with a diameter that exceeds the dimensions of the receiver sockets 40, 42 by a predetermined amount to achieve a frictional fit upon insertion of the bearing pins 52, 54 into the respective receiver sockets 40, 42. In a preferred embodiment, the bearing receivers 36, 38 are each formed with a respective narrow, elongated slot 60, 62 communicating with the bearing receiver sockets 38, 40 respectively. The narrow, elongated slots 60, 62 extend across the width of the respective bearing receivers 36, 38 and provide the bearing receiver sockets 40, 42 with a resilient characteristic. Thus, a resilient retention arrangement is achieved between the bearing receivers 36, 38 and the bearing pins 52, 54. Upon insertion of the bearing pins 52, 54 into the respective bearing receiver sockets 40, 42 the larger dimensioned bearing pins 52, 54 deform the respective lower branches 44, 46 wherein the bearing pins 52, 54 are resiliently retained in a frictional fit relationship with the bearing receivers 36, 38.

In accordance with other important aspects of the present invention, the housing portion 14 is molded or fabricated to define retention flanges 70, 72 FIGS. 1 and 3. The retention flanges 70, 72 are fabricated with a right angle cross section and extend inward from the edgewall 30 and downward from the strengthening flange 32. The flanges 70, 72 engage the retained bearing pins 52, 54 respectively and the bearing receivers 36, 38 respectively upon the mating engagement of the housing portion 14 about the inserted handle 10 and with the first housing portion 12.

The housing portion 14 is also fabricated with a handle receiving recess 74, FIG. 1, having a general U-shape corresponding to that of the handle 10. Further, the strengthening flange portion 32 of the housing 14 includes open slots 76, 78, FIG. 3, communicating with the legs of the U-shaped recess 74 to accommodate the leg portions 22, 24 respectively upon rotation of the handle 10 to the flat recessed storage position within the recess 74.

Upon insertion of the handle 10 into the bearing receivers 36, 38, the spacer feet 56 and 58 of the respective legs 18 and 20 are caught between the housing portions 12 and 14. Further, the spacer feet 56 and 58 provide control of lateral movement, that is movement along an axis of the bearing pins 52, 54 and the elongated portion of the base 12 of the handle. The lateral control is achieved by contact of the spacer feet 56, 58 with the bearing receivers 36, 38 respectively. In this regard, the feet 56 and 58 include respective raised contact surfaces 80, 82 to aid in this retention function with the outward facing side edges of the raised contact surfaces 80, 82 abutting the inward facing side edges of the bearing receivers 36, 38 along the overhanging branches 48, 50 respectively. The raised contact surfaces 80, 82 along their top surfaces abut the strengthening flange 28 when the handle 10 is in the upright carrying position. This contact distributes the weight of the projector when being carried and eliminates excessive strains on the bearing pins 52, 54. Further, the abutment of the contact surfaces 80, 82 with the strengthening flange 28 defines a mechanical limit to the rotation of the handle in the upright carrying position.

Figure 6:
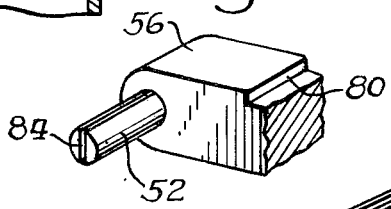
FIG. 6 is an enlarged fragmentary perspective view of the carrying handle of FIGS. 1 and 2 illustrating an alternate resilient retention arrangement.

In accordance with an alternate embodiment of the present invention and referring now to FIG. 6, the bearing pins 52, 54 include a diametric slot 84 extending along a substantial axial length of the bearing pins to provide the resilient retention arrangement upon insertion into the bearing receivers 36, 38. In this embodiment, the resilient retention arrangement provided by the slotted bearing pins 52, 54 is utilized as an alternative to the elongated slots 60, 62 of the bearing receivers 36, 38. However, it should be understood, that the present invention contemplates the provision of either or both resilient retention arrangements as well as other arrangements that provide a resilient retention of the bearing pins 52, 54 within the bearing receivers 36, 38 to establish a frictional fit relationship. Slots 60 and 62 while shown aligned with (parallel) the sockets 40 and 42 can be placed normal to the plane of the sockets such that the inner walls of bearing receivers 36 and 38 are resiliently biassed towards the faces of 56 and 58 which mount the pins 52 and 50 to provide a friction fit.

While there has been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A carrying handle arrangement for a projector housing or the like comprising:

a first housing portion including a pair of spaced bearing receivers each defining a receiver socket;

a carrying handle including an elongated base portion and two extending legs, each of said legs including an elongated bearing pin arranged to fit with said receiver sockets;

a second housing portion for mating engagement with said first housing portion to retain said handle within said receiver sockets; and means for resiliently retaining said bearing pins within said receiver sockets in a frictional fit relationship and permitting rotation of said carrying handle about an axis through said bearing pins, said resilient retention means comprising an elongated slotted portion formed in each of said bearing receivers and interconnecting with each of said respective bearing receiver sockets to provide said bearing receiver sockets with a resilient characteristic and the diameter of said bearing pins being a predetermined dimension larger than the interfitting dimension of said bearing receiver sockets.

2. The carrying handle arrangement of claim 1 wherein said second housing portion further comprises means for mating with said bearing receivers and said bearing pins to aid in the retention of said bearing pins within said bearing receiver sockets.

3. The carrying handle arrangement of claim 2 wherein said carrying handle is rotatable from a first generally upright position for carrying and a second recessed storage position into said second housing portion.

4. The carrying handle arrangement of claim 3 wherein said handle legs include a first portion at right angles to said base portion generally forming a U and a second arcuate portion extending between said first portion and said bearing pins.

5. The carrying handle arrangement of claim 4 wherein said second housing portion defines a handle receiver recess, said handle base portion and said first leg portions fit within said handle receiver recess in said storage positions, and said arcuate portions extend into the space defined between said two housing portions.

6. The carrying handle arrangement of claim 5 wherein said handle receiver recess defined in said second housing portion is generally the same shape as said retained handle base and said first leg portions.

7. The carrying handle arrangement of claim 6 wherein said handle receiver recess defines two open slots along the edge of said second housing portion that mates with said second arcuate leg portions.

8. The carrying handle arrangement of claim 4 wherein each of said second arcuate leg portions includes an elongated spacer portion extending perpendicular to the plane of each of said arcuate portions and carrying said bearing pins.

9. The carrying handle arrangement of claim 8 wherein said bearing pins extend perpendicular to said second arcuate leg portions.

10. The carrying handle arrangement of claim 8 wherein said first housing portion includes means for mating engagement with said elongated spacer portions to control movement of said carrying handle in a direction of the axis through said bearing pins.

11. The carrying handle arrangement of claim 8 wherein said spacer portion contacts said first housing portion in said first carrying position.

12. A carrying handle arrangement for a projector housing or the like comprising:

a first housing portion including a pair of spaced bearing receivers each defining a receiver socket;

a carrying handle including an elongated base portion and two extending legs, each of said legs including an elongated bearing pin arranged to fit with said receiver sockets;

a second housing portion for mating engagement with said first housing portion to retain said handle within said receiver sockets; and means for resiliently retaining said bearing pins within said receiver sockets in a frictional fit relationship and permitting rotation of said carrying handle about an axis through said bearing pins, said resilient retention means comprising the diameter of said bearing pins being a predetermined dimension larger than the interfitting dimension of said bearing receiver sockets and each of said bearing pins including a diametric slot extending along a substantial axial length of each of said elongated bearing pins to provide said elongated bearing pins with a resilient characteristic.

* * * * *